US011554469B2

(12) United States Patent
Chiang

(10) Patent No.: US 11,554,469 B2
(45) Date of Patent: Jan. 17, 2023

(54) TOOL CONNECTOR

(71) Applicant: SHIN YING ENTPR CO., LTD., Taichung (TW)

(72) Inventor: Wen-Hung Chiang, Taichung (TW)

(73) Assignee: SHIN YING ENTPR CO., LTD., Taichung (TW)

( * ) Notice: Subject to any disclaimer, the term of this patent is extended or adjusted under 35 U.S.C. 154(b) by 189 days.

(21) Appl. No.: 17/097,822

(22) Filed: Nov. 13, 2020

(65) Prior Publication Data

US 2022/0152795 A1 May 19, 2022

(51) Int. Cl.

| | |
|---|---|
| ***B25B 23/00*** | (2006.01) |
| ***B25B 23/12*** | (2006.01) |
| ***B25B 21/00*** | (2006.01) |

(52) U.S. Cl.

CPC ..... *B25B 23/0035* (2013.01); *B25B 23/12* (2013.01); *B25B 21/00* (2013.01)

(58) Field of Classification Search

CPC ..... B25B 23/0035; B25B 23/12; B25B 21/00; B25B 23/0021

USPC ..... 81/125, 177.85, 436–439

See application file for complete search history.

(56) References Cited

U.S. PATENT DOCUMENTS

| | | | | |
|---|---|---|---|---|
| 8,651,764 | B2 * | 2/2014 | Lin | F16B 21/165 81/177.85 |
| 10,307,896 | B2 * | 6/2019 | Shu | B23B 31/107 |
| 10,434,632 | B2 * | 10/2019 | Chang | B25B 23/0035 |
| 11,325,230 | B2 * | 5/2022 | Chiang | B25B 23/0035 |
| 2004/0126182 | A1 * | 7/2004 | Lin | B25B 23/0021 403/322.2 |
| 2018/0215020 | A1 * | 8/2018 | Dumitru | B25B 23/12 |

FOREIGN PATENT DOCUMENTS

| | | |
|---|---|---|
| TW | M435342 U | 8/2012 |
| TW | M469991 U | 1/2014 |
| TW | M503983 U | 7/2015 |
| TW | I515092 B | 1/2016 |

* cited by examiner

*Primary Examiner* — Lee D Wilson
*Assistant Examiner* — Jason Khalil Hawkins
(74) *Attorney, Agent, or Firm* — Muncy, Geissler, Olds & Lowe, P.C.

(57) ABSTRACT

A tool connector is provided, including: a rod, a sliding sleeve, a locking member, a push rod, a sliding rod, a first elastic member and a second elastic member. The sliding sleeve is movably sleeved to the rod. The sliding rod is disposed through the push rod and slidably disposed on the rod. The sliding rod is comovable with the push rod. The first elastic member is elastically abutted against and between the push rod and the rod. The second elastic member is elastically abutted against and between the rod and the sliding sleeve.

1 Claim, 6 Drawing Sheets

TOOL CONNECTOR

BACKGROUND OF THE INVENTION

Field of the Invention

The present invention relates to a tool connector.

Description of the Prior Art

Generally, a tool connector is assembled to a rotary tool and configured to connect with a variety of adaptors (such as sockets and bits) which are respectively adapted to be assembled with corresponding fasteners (such as screws and nuts). Therefore, the rotary tool is able to drive one of various fasteners to rotate according to operating requirements, which allows quick assembling. The tool connectors, such as disclosed in Taiwan Patents I515092, M503983, M469991 and M435342, are used with a purpose as described above.

However, a conventional tool connector is inconvenient to use. For example, a sliding sleeve of the conventional tool connector cannot be smoothly and stably moved; the conventional tool connector cannot be stably assembled with a socket; and components are not moved instantaneously with operation.

The present invention is, therefore, arisen to obviate or at least mitigate the above-mentioned disadvantages.

SUMMARY OF THE INVENTION

The main object of the present invention is to provide a tool connector which is smoothly operated and configured to be quickly assembled with and disassembled from a sleeving member.

To achieve the above and other objects, the present invention provides a tool connector, including: a rod, a sliding sleeve, a locking member, a push rod, a sliding rod, a first elastic member and a second elastic member. The rod includes an interior space, a sliding groove and a receiving hole, and the sliding groove and the receiving hole are respectively communicated with the interior space. The sliding sleeve is movably sleeved to the rod. The locking member is movably restricted within the receiving hole and configured to be selectively engaged with a sleeving member. The push rod is received in the interior space and movable between a locking position and a release position relative to the receiving hole. The push rod urges the locking member to protrude beyond an outer surface of the rod when the push rod is in the locking position, and the locking member is free of urging and protrudable into the interior space when the push rod is in the release position. The sliding rod is disposed through the push rod and slidably disposed within the sliding groove, and the sliding rod is comovable with the push rod. The sliding rod is interferable with the sliding sleeve in a moving direction of the sliding sleeve. The first elastic member is elastically abutted against and between the push rod and the rod so that the push rod has a tendency to move in a direction toward the locking position. The second elastic member is elastically abutted against and between the sliding rod and the sliding sleeve.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
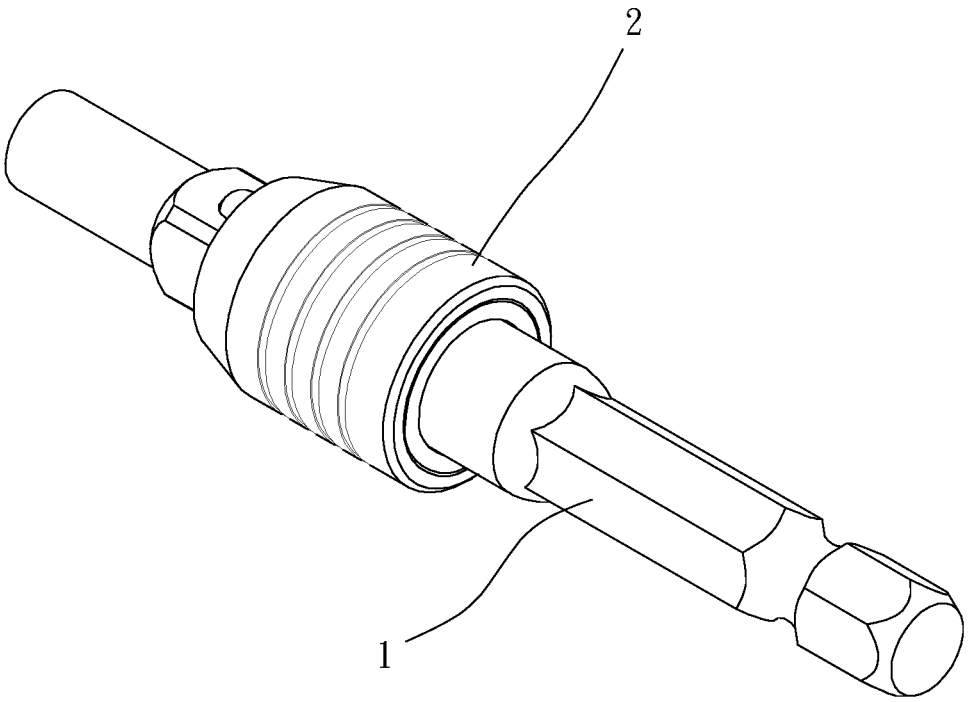
FIG. 1 is a stereogram of a preferable embodiment of the present invention.
Figure 2:
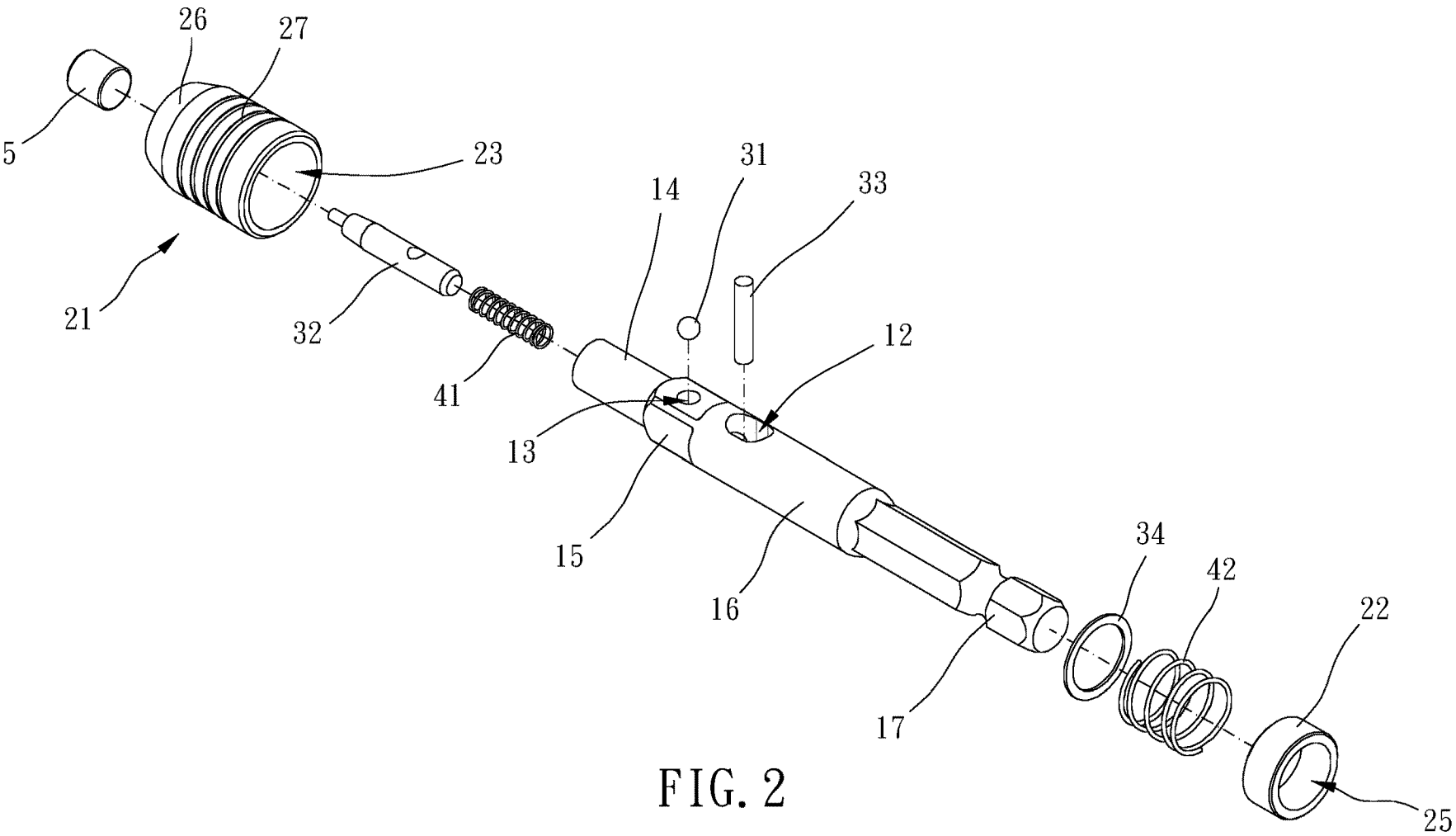
FIG. 2 is a breakdown drawing of FIG. 1.
Figure 3:
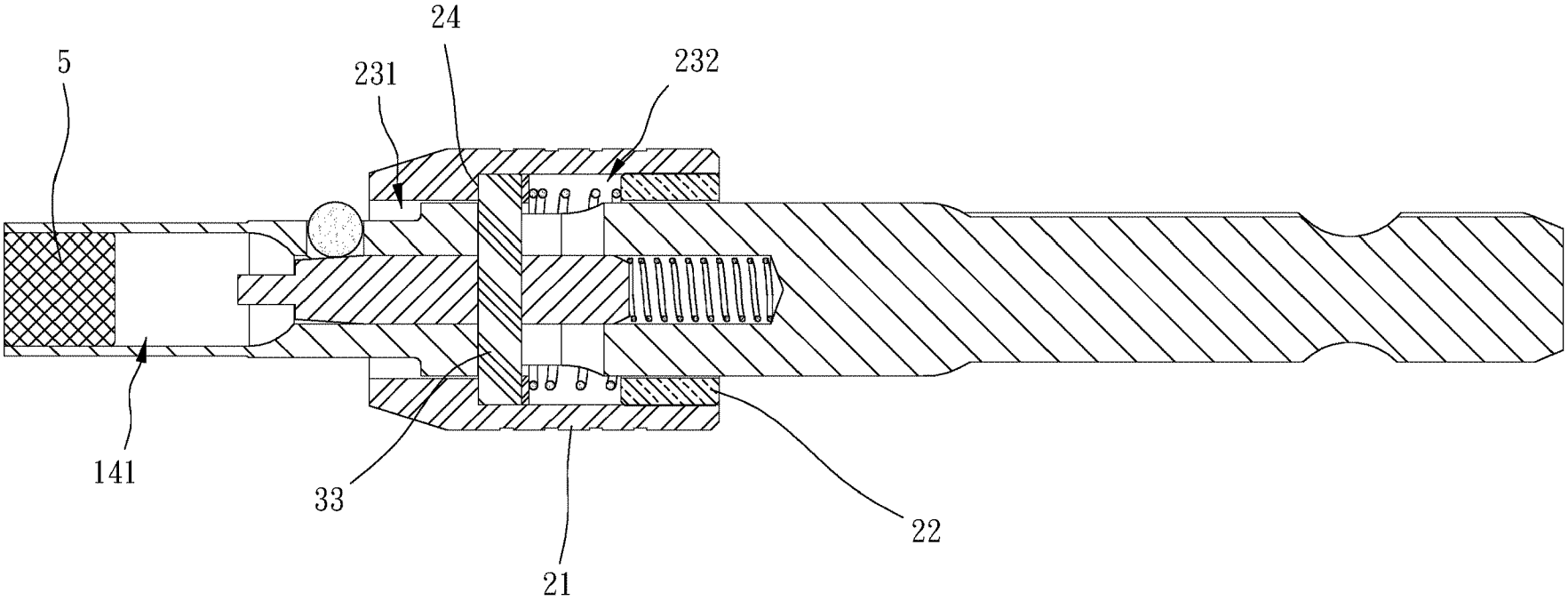
FIG. 3 is a cross-sectional view of FIG. 1.
Figure 4:
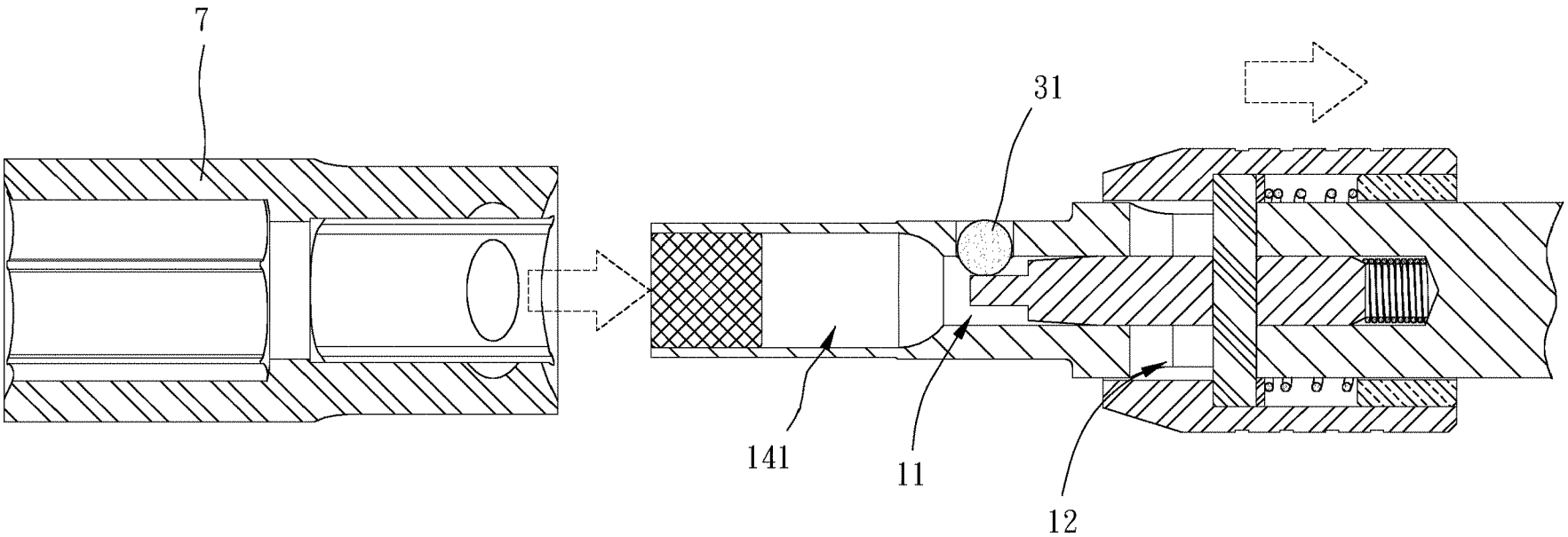
FIGS. 4 and 5 are schematic diagrams showing operation of a preferable embodiment of the present invention.
Figure 5:
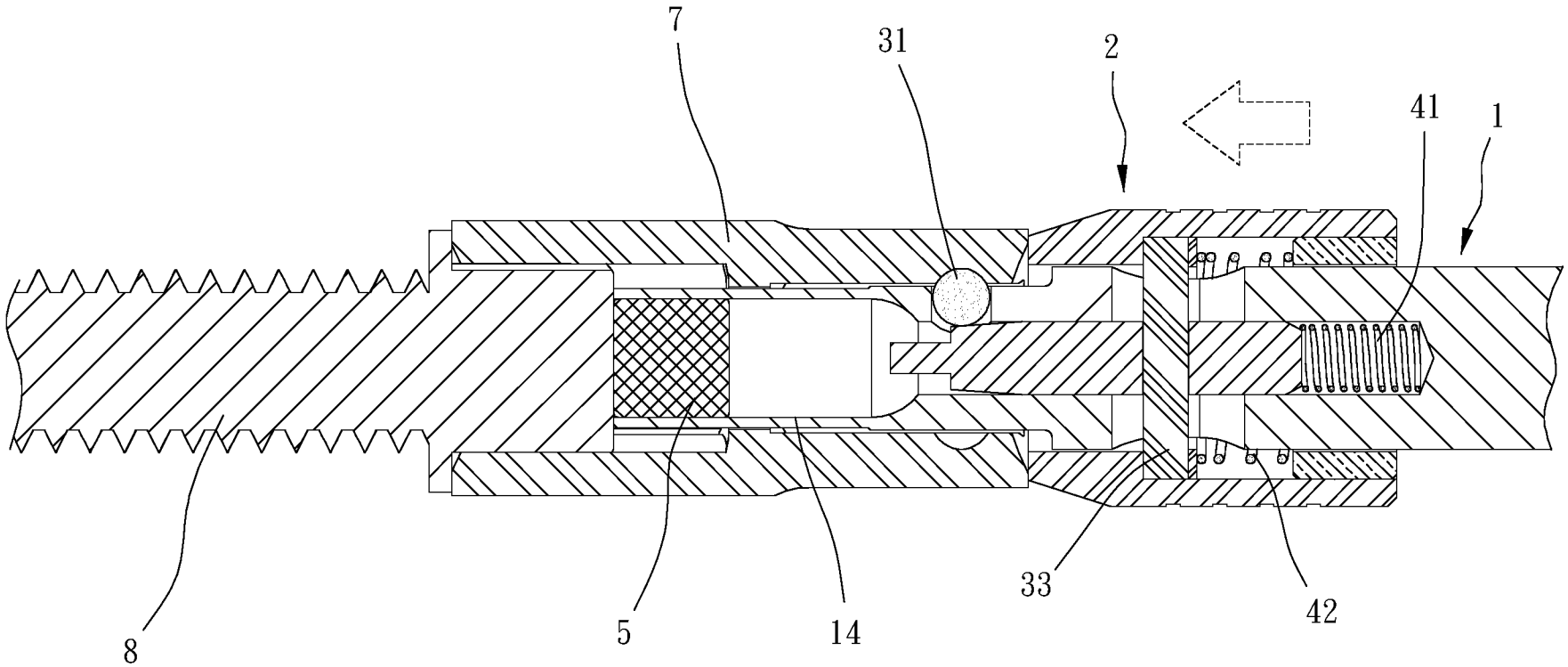
Figure 6:
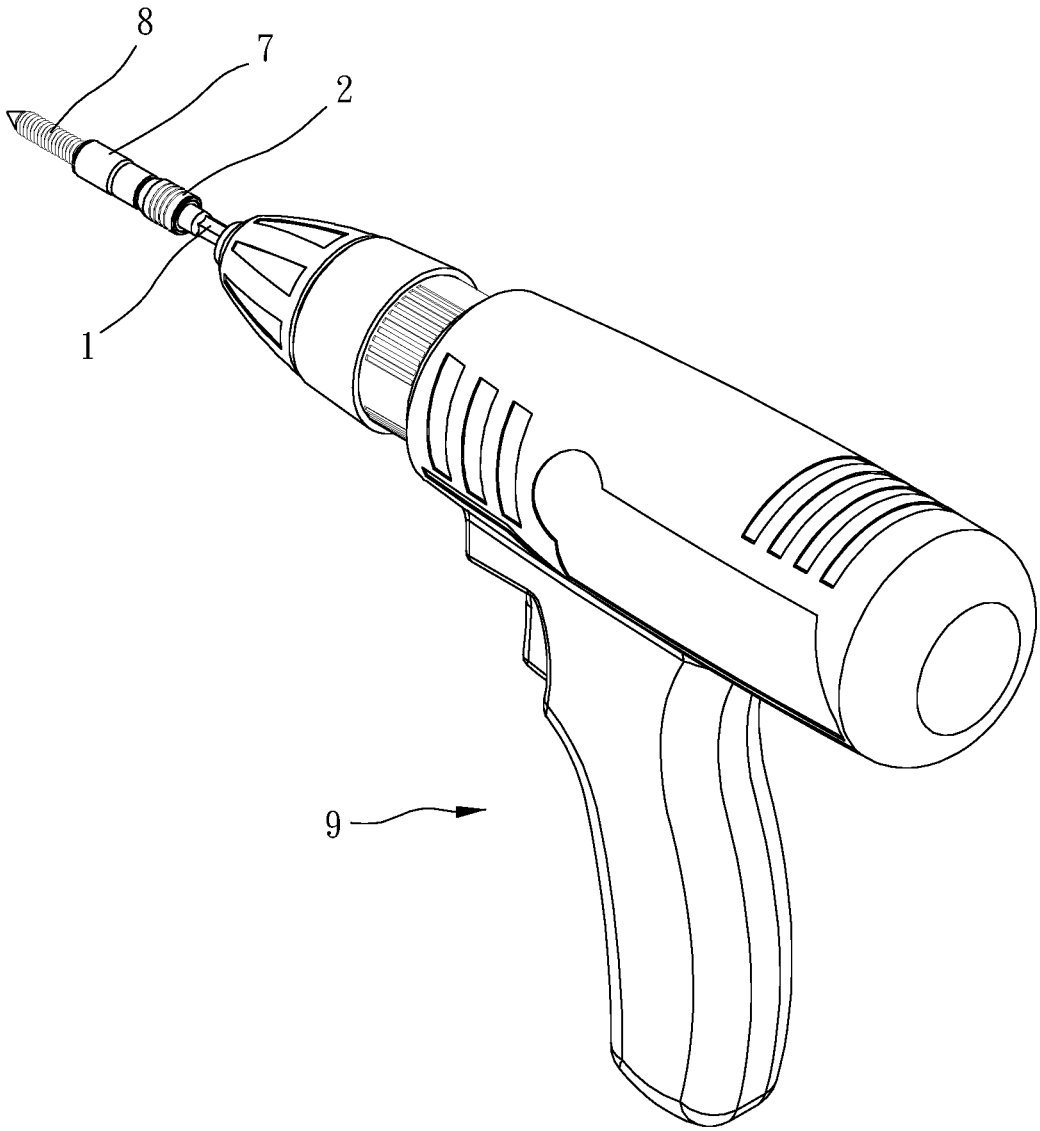
FIG. 6 is a schematic diagram of a preferable embodiment of the present invention in use.

Please refer to FIGS. 1 to 6 for a preferable embodiment of the present invention. A tool connector of the present invention includes a rod 1, a sliding sleeve 2, a locking member 31, a push rod 32, a sliding rod 33, a first elastic member 41 and a second elastic member 42.

The rod 1 includes an interior space 11, a sliding groove 12 and a receiving hole 13, and the sliding groove 12 and the receiving hole 13 are respectively communicated with the interior space 11. The sliding sleeve 2 is movably sleeved to the rod 1. The locking member 31 is movably restricted within the receiving hole 13 and configured to be selectively engaged with a sleeving member 7 such as a socket.

The push rod 32 is received in the interior space 11 and movable between a locking position and a release position relative to the receiving hole 13. When the push rod 32 is in the locking position, the push rod 32 urges the locking member 31 to protrude beyond an outer surface of the rod 1 to be engaged with the sleeving member 7; when the push rod 32 is in the release position, the locking member 31 is free of urging and protrudable into the interior space 11 so that the sleeving member 7 is releasable therefrom. The sliding rod 33 is disposed through the push rod 32 and slidably disposed within the sliding groove 12, and the sliding rod 33 is comovable with the push rod 32. The sliding rod 33 is interferable with the sliding sleeve 2 in a moving direction of the sliding sleeve 2 so that the sliding rod 33 is comovable with the sliding sleeve 2. The first elastic member 41 is elastically abutted against and between the push rod 32 and the rod 1 so that the push rod 32 has a tendency to move in a direction toward the locking position so as to be stably engaged with the sleeving member 7 for safe operation.

Specifically, the second elastic member 42 is abutted against the sliding sleeve 2 and located between the sliding rod 33 and the sliding sleeve 2. The second elastic member 42 provides elastic force to the sliding sleeve 2, which allows the sliding sleeve 2 to be stably moved along the sliding rod 33 between the locking position and the release position. In addition, with the second elastic member 42, tolerance of dimensional errors between components is increased, in other words, requirements of dimensions and assembling accuracy of the sliding sleeve 2 and the rod 1 are decreased, which allows quick assembling and low cost.

In this embodiment, a diametrical dimension of the second elastic member 42 is larger than a diametrical dimension of the first elastic member 41, and the second elastic member 42 is sleeved to the rod 1 so as to prevent the second elastic member 42 from lateral distortion during compression or extension. Moreover, an elastic force of the first elastic member 41 is larger than an elastic force of the second elastic member 42 so that the push rod 32 keeps in the locking position when the sliding sleeve 2 is unforced.

Preferably, the tool connector further includes a cushion 34. The cushion 34 is received in the sliding sleeve 2 and sleeved to the rod 1, and the cushion 34 is disposed between the sliding rod 33 and the second elastic member 42. The cushion 34 provides a larger contact area for the second elastic member 42 to be stably abutted against thereon so that force is evenly transmitted and the sliding rod 33 is stably slidable.

The sliding sleeve 2 has a receiving room 23 disposed therethrough, and the receiving room 23 is communicated with the sliding groove 12. The rod 1 is disposed through the receiving room 23. The sliding rod 33 protrudes beyond the sliding groove 12 and extends into the receiving room 23, and the second elastic member 42 is received in the receiving room 23. Moreover, the receiving room 23 includes a first receiving portion 231 and a second receiving portion 232 which are cylindrical, and a diametrical dimension of the first receiving portion 231 is smaller than a diametrical dimension of the second receiving portion 232. A stepped portion 24 is formed between the first receiving portion 231 and the second receiving portion 232, and the sliding rod 33 is abutted against and between the second elastic member 42 and the stepped portion 24 so that the sliding sleeve 2 and the sliding rod 33 are comovable instantaneously with each other.

Specifically, the sliding sleeve 2 includes a first member 21 and a second member 22. The first member 21 has the receiving room 23 disposed therethrough, and the second member 22 is disposed within the receiving room 23. The second member 22 has an annular opening 25 communicated with the receiving room 23, and the second elastic member 42 is elastically abutted against and between the second member 22 and the sliding rod 33. In assembling, the first member 21 is sleeved to a front end of the rod 1 and the second elastic member 42 is placed into the receiving room 23, and then the second member 22 is assembled to the first member 21 from a rear end of the rod 1, which is easy to be assembled.

In this embodiment, the second member 22 is connected with the first member 21 in tight-fit so as to reduce components and simplify assembling process. An end of the first member 21 remote from the second member 22 includes an inclined portion 26, and the inclined portion 26 is inclined toward the receiving hole 13 so as to avoid unexpected movement of the sliding sleeve 2. In addition, an outer surface of the first member 21 has a plurality of grooves 27 disposed thereon so as to increase contact area and be convenient for operation.

Preferably, the tool connector further includes a magnet 5, and the magnet 5 is disposed within an extending portion 14 of the rod 1, and the extending portion 14 is configured to protrude into an interior of the sleeving member 7 and attract a magnetic member 8, such as screws, bolts, nuts and so on, which prevents the magnetic member 8 from removing from the sleeving member 7.

The rod 1 includes the extending portion 14, a first main portion 15, a second main portion 16 and an assembling portion 17 which are connected with one another in sequence. The extending portion 14 defines an extending space 141. The receiving hole 13 is disposed on the first main portion 15, and the sliding groove 12 is disposed on the second main portion 16. The assembling portion 17 is configured to be connected with a driving tool 9 (such as an electric drill tool). A length of the extending portion 14 is larger than a length of the first main portion 15 so as to preferably penetrate into the sleeving member 7, and the magnet 5 is received within the extending space 141 so as to avoid unexpected collision. The interior space 11 is disposed through the first main portion 15 and the second main portion 16 and communicated with the extending space 141. Part of the push rod 32 selectively protrudes into the extending space 141 from the interior space 11. In this embodiment, the first main portion 15 is rectangular block-shaped so as to be engaged with the sleeving member 7; the second main portion 16 is round rod-shaped, which allows the sliding sleeve 2 to be slid thereon; the extending portion 14 is also round rod-shaped, which is convenient to protrude into the sleeving member 7 to magnetically attract the magnetic member 8.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool connector, including:

a rod, including an interior space, a sliding groove and a receiving hole, the sliding groove and the receiving hole being respectively communicated with the interior space;

a sliding sleeve, movably sleeved to the rod;

a locking member, movably restricted within the receiving hole and configured to be selectively engaged with a sleeving member;

a push rod, received in the interior space and being movable between a locking position and a release position relative to the receiving hole, the push rod urging the locking member to protrude beyond an outer surface of the rod when the push rod is in the locking position, the locking member being free of urging and protrudable into the interior space when the push rod is in the release position;

a sliding rod, disposed through the push rod and slidably disposed within the sliding groove, the sliding rod being comovable with the push rod, the sliding rod being interferable with the sliding sleeve in a moving direction of the sliding sleeve;

a first elastic member, elastically abutted against and between the push rod and the rod so that the push rod has a tendency to move in a direction toward the locking position; and a second elastic member, abutted against the sliding sleeve and located between the sliding rod and the sliding sleeve, wherein the sliding sleeve has a receiving room disposed therethrough, the receiving room is communicated with the sliding groove, the rod is disposed through the receiving room, the sliding rod protrudes beyond the sliding groove and extends into the receiving room, and the second elastic member is received in the receiving room, wherein the sliding sleeve includes a first member and a second member, the first member has the receiving room disposed therethrough, the second member is disposed within the receiving room, the second member has an annular opening communicated with the receiving room, and the second elastic member is abutted against the second member, wherein an end of the first member remote from the second member includes an inclined portion, and the inclined portion is inclined toward the receiving hole, and wherein the receiving room includes a first receiving portion and a second receiving portion which are cylindrical, a diametrical dimension of the first receiving portion is smaller than a diametrical dimension of the second receiving portion, a stepped portion is formed between the first receiving portion and the second receiving portion, and the sliding rod is abutted against the stepped portion and located between the second elastic member and the stepped portion; a diametrical dimension of the second elastic member is larger than a diametrical dimension of the first elastic member, the second elastic member is sleeved to the rod; the tool connector further includes a magnet and a cushion, the magnet is disposed within an extending portion of the rod, the extending portion is configured to protrude into an interior of the sleeving member and attract a magnetic member, the cushion is received in the sliding sleeve and sleeved to the rod, the cushion is disposed between the sliding rod and the second elastic member; the rod includes the extending portion, a first main portion, a second main portion and an assembling portion which are connected with one another in sequence, the extending portion defines an extending space, the receiving hole is disposed on the first main portion, the sliding groove is disposed on the second main portion, the assembling portion is configured to be connected with a driving tool, a length of the extending portion is larger than a length of the first main portion, the magnet is received within the extending space, the interior space is disposed through the first main portion and the second main portion and communicated with the extending space, and part of the push rod selectively protrudes into the extending space from the interior space; an elastic force of the first elastic member is larger than an elastic force of the second elastic member; the second member is connected with the first member in tight-fit an outer surface of the first member has a plurality of grooves disposed thereon; the first main portion is rectangular block-shaped; the second main portion is round rod-shaped; and the extending portion is round rod-shaped.

* * * * *